US007918105B2

(12) United States Patent
Kim

(10) Patent No.: US 7,918,105 B2
(45) Date of Patent: Apr. 5, 2011

(54) ICE MAKING DEVICE AND REFRIGERATOR HAVING THE SAME

(75) Inventor: Moon-Won Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 494 days.

(21) Appl. No.: 11/852,055

(22) Filed: Sep. 7, 2007

(65) Prior Publication Data

US 2008/0209936 A1 Sep. 4, 2008

(30) Foreign Application Priority Data

Sep. 11, 2006 (KR) ..... 10-2006-0087597

(51) Int. Cl.
*F25C 5/06* (2006.01)

(52) U.S. Cl. ..... 62/353; 249/69; 249/137; 425/429; 425/440

(58) Field of Classification Search ..... 62/66–74, 62/340–356; 249/66.1, 69–71, 137; 425/439–440
See application file for complete search history.

(56) References Cited

U.S. PATENT DOCUMENTS

| | | | | |
|---|---|---|---|---|
| 3,273,353 | A * | 9/1966 | Horvay et al. | 62/353 |
| 3,545,717 | A * | 12/1970 | Pietrzak et al. | 249/69 |
| 3,727,427 | A * | 4/1973 | Eyman et al. | 62/353 |
| 6,148,620 | A * | 11/2000 | Kumagai et al. | 62/72 |
| 6,481,235 | B2 * | 11/2002 | Kwon | 62/353 |

FOREIGN PATENT DOCUMENTS

| | | | |
|---|---|---|---|
| CN | 2099944 | U | 3/1992 |
| CN | 1153737 | A | 7/1997 |
| CN | 1337557 | A | 2/2002 |
| JP | 6-323702 | A | 11/1994 |
| JP | 2005-351622 | A | 12/2005 |

* cited by examiner

*Primary Examiner* — William E Tapolcai
(74) *Attorney, Agent, or Firm* — Birch, Stewart, Kolasch & Birch, LLP

(57) ABSTRACT

An ice making device that is capable of more easily and conveniently separating ice from ice trays through a simple manipulation and a refrigerator having the same are disclosed. The ice making device includes a support frame for rotatably supporting at least one ice tray, at least one manipulation button mounted to the support frame such that the manipulation button can be moved forward and backward, and an interlocking unit for rotating the ice tray with respect to the support frame according to the movement of the manipulation button.

19 Claims, 7 Drawing Sheets

ICE MAKING DEVICE AND REFRIGERATOR HAVING THE SAME

CROSS-REFERENCE TO RELATED APPLICATION

This application claims the benefit of Korean Patent Application No. 10-2006-0087597, filed on Sep. 11, 2006, which is hereby incorporated by reference in its entirety as if fully set forth herein.

BACKGROUND OF THE INVENTION

1. Field of the Invention

The present invention relates to an ice making device and a refrigerator having the same, and more particularly, to an ice making device that is capable of easily and conveniently making and separating ice and a refrigerator having the same.

2. Discussion of the Related Art

A refrigerator is an electric home appliance that freezes or refrigerates food to store the food in a fresh state for a long period of time. The refrigerator includes a freezing compartment and a refrigerating compartment. In the freezing compartment is mounted an ice making device for making ice.

FIG. 9 is a front view illustrating a conventional refrigerator, and FIG. 10 is a plan view illustrating an ice making device of the refrigerator shown in FIG. 9.

As shown in FIGS. 9 and 10, the refrigerator includes a refrigerator body 10 having a freezing compartment 11 and a refrigerating compartment 13 defined therein such that the freezing compartment 11 is located at the left side of the refrigerator body 10, and the refrigerating compartment 13 is located at the right side of the refrigerator body 10. To the refrigerator body 10 are mounted a freezing compartment door 11*a* and a refrigerating compartment door 13*a* for selectively opening and closing the freezing compartment 11 and the refrigerating compartment 13.

Specifically, the freezing compartment door 11*a* and the refrigerating compartment door 13*a* are mounted to opposite sides of the refrigerator body 10, respectively, such that the freezing compartment door 11*a* and the refrigerating compartment door 13*a* are hingedly rotated in the forward and backward direction of the refrigerator body 10.

At one side of the freezing compartment 11 is mounted an ice making device 19. The ice making device 19 is a device that makes ice. Specifically, the ice making device 19 is mounted in the freezing compartment 11 such that the ice making device 19 can be inserted into and withdrawn from the freezing compartment 11. As shown in FIG. 10, the ice making device 19 includes a support frame 21 and a pair of ice trays 23.

The support tray 21 serves to rotatably support the ice trays 23. To this end, the support frame 21 is formed in the shape of a rectangular frame. The ice trays 23 are mounted in the support tray 21 such that the ice trays 23 can be individually rotated.

At each ice tray 23 are formed a plurality of ice making grooves 23*a*. To the centers of the front and rear of each ice tray 23 are mounted rotary shafts 24, respectively. The ice trays 23 are rotated about the rotary shafts 24 in the clockwise or counterclockwise direction when viewed on the drawing of FIG. 9. To this end, the rotary shafts 24 are rotatably fitted in the rear of the support frame 21.

Referring to FIG. 10, stoppers 25 are formed at the inner side of the support frame 21, corresponding to the left sides of the respective rotary shafts 24 mounted at the rear ends of the ice trays 23, such that the stoppers 25 protrude inward.

Each stopper 25 supports the corresponding ice tray 23 such that the ice tray 23 is horizontally maintained while the lower end of the ice tray 23 is located at the top of the stopper 25. Also, each stopper 25 serves to twist the front end of the corresponding ice tray 23 with respect to the rear end of the ice tray 23 when the ice tray 23 is rotated about the corresponding rotary shaft 24.

At the front of the support frame 21, corresponding to the front of the ice trays 23 are mounted manipulation levers 26, which protrude forward. The manipulation levers 26 are gripped by hands of a user such that the user rotates the ice trays 23.

The manipulation levers 26 correspond to the ice trays 23, and therefore, the manipulation levers 26 are provided in a pair. Each manipulation lever 26 is connected to the rotary shaft 24 mounted to the front of the corresponding ice tray 23. Consequently, when the user rotates the manipulation levers 26, the rotary shafts 24 are rotated. As a result, the ice trays 23 are rotated by a predetermined angle, and then the rear ends of the ice trays 23 are brought into contact with the corresponding stoppers 25, whereby the front ends of the ice trays 23 are twisted with respect to the rear ends of the ice trays 23.

Referring back to FIG. 9, on the other hand, an ice bank 27 is mounted below the ice making device in the freezing compartment 11. The ice bank 27 serves to store ice made by the ice making device 19. Specifically, the ice bank 27 is mounted in the freezing compartment 11 such that the ice bank 27 can be inserted into and withdrawn from the freezing compartment 11.

However, the ice making device of the conventional refrigerator with the above-stated construction has the following problem.

It is required that the ice trays 23 be rotated through the rotation of the manipulation levers 26 in order to separate ice in the ice making grooves 23*a* from the ice trays 23. To this end, a user must twist his/her wrists while holding the manipulation levers 26 by hand, with the result that the wrists of the user may be injured.

SUMMARY OF THE INVENTION

Accordingly, the present invention is directed to an ice making device and a refrigerator having the same that substantially obviates one or more problems due to limitations and disadvantages of the related art.

An object of the present invention is to provide an ice making device that is capable of more easily and conveniently separating ice from ice trays and a refrigerator having the same.

Additional advantages, objects, and features of the invention will be set forth in part in the description which follows and in part will become apparent to those having ordinary skill in the art upon examination of the following or may be learned from practice of the invention The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an ice making device includes a support frame for rotatably supporting at least one ice tray, at least one manipulation button mounted to the support frame such that the manipulation button can be moved forward and backward, and an interlocking unit for rotating the ice tray with respect to the support frame according to the movement of the manipulation button.

Preferably, the interlocking unit includes a guide protrusion protruding from the manipulation button, and a guide groove formed at the ice tray such that the guide protrusion is guided along the guide groove while the guide protrusion is fitted in the guide groove, the guide groove being formed in the shape of an arc and constructed in a structure in which the depth of the guide groove is gradually increased from one end to the other end of the guide groove.

Preferably, the guide groove is formed such that the guide groove is concentric with a support hole formed at the rotational center of the ice tray.

Preferably, the interlocking unit further includes a support shaft protruding from the manipulation button, the support shaft being fitted in a support hole formed at the ice tray through the support frame such that the support shaft can be moved forward and backward.

Preferably, the support frame is provided with a button mounting part, which is formed in a depressed shape for receiving the manipulation button.

Preferably, the button mounting part is provided with a pair of through-holes, through which the guide protrusion and the support shaft are inserted, respectively.

Preferably, the support shaft is provided with a catching protrusion for preventing the support shaft from being separated from a position where the support shaft is inserted through the corresponding through-hole.

Preferably, the ice making device further includes an elastic member for applying a restoring force to the ice tray such that the ice tray can be rotated in the direction opposite to the rotating direction of the ice tray in which the ice tray is rotated by the manipulation button.

Preferably, the elastic member has opposite ends fixed to the support frame and the ice tray, respectively.

Preferably, the support frame supports the ice tray such that opposite ends of the ice tray are twisted with respect to each other after the ice tray is rotated by a predetermined angle.

In another aspect of the present invention, a refrigerator has an ice making device. The ice making device includes a support frame mounted at the inside of a door for rotatably supporting at least one ice tray, at least one manipulation button mounted to the support frame such that the manipulation button can be moved forward and backward, and an interlocking unit for rotating the ice tray with respect to the support frame according to the movement of the manipulation button. The interlocking unit includes a guide protrusion protruding from the manipulation button, and a guide groove formed at the ice tray such that the guide protrusion is guided along the guide groove while the guide protrusion is fitted in the guide groove, the guide groove being constructed in a structure in which the depth of the guide groove is gradually increased from one end to the other end of the guide groove.

Preferably, guide groove is formed in the shape of an arc.

Preferably, the guide groove is formed such that the guide groove is concentric with a support hole formed at the rotational center of the ice tray.

Preferably, the interlocking unit further includes a support shaft protruding from the manipulation button, the support shaft being fitted in a support hole formed at the ice tray through the support frame such that the support shaft can be moved forward and backward.

Preferably, the support frame is provided with a button mounting part, which is formed in a depressed shape for receiving the manipulation button.

Preferably, the button mounting part is provided with a pair of through-holes, through which the guide protrusion and the support shaft are inserted, respectively.

Preferably, the support shaft is provided with a catching protrusion for preventing the support shaft from being separated from a position where the support shaft is inserted through the corresponding through-hole.

Preferably, the ice making device further includes an elastic member for applying a restoring force to the ice tray such that the ice tray can be rotated in the direction opposite to the rotating direction of the ice tray in which the ice tray is rotated by the manipulation button.

Preferably, the elastic member has opposite ends fixed to the support frame and the ice tray, respectively.

Preferably, the support frame supports the ice tray such that opposite ends of the ice tray are twisted with respect to each other after the ice tray is rotated by a predetermined angle.

According to the present invention with the above-described construction, it is possible to more easily and conveniently separate ice from ice trays through a simple manipulation.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
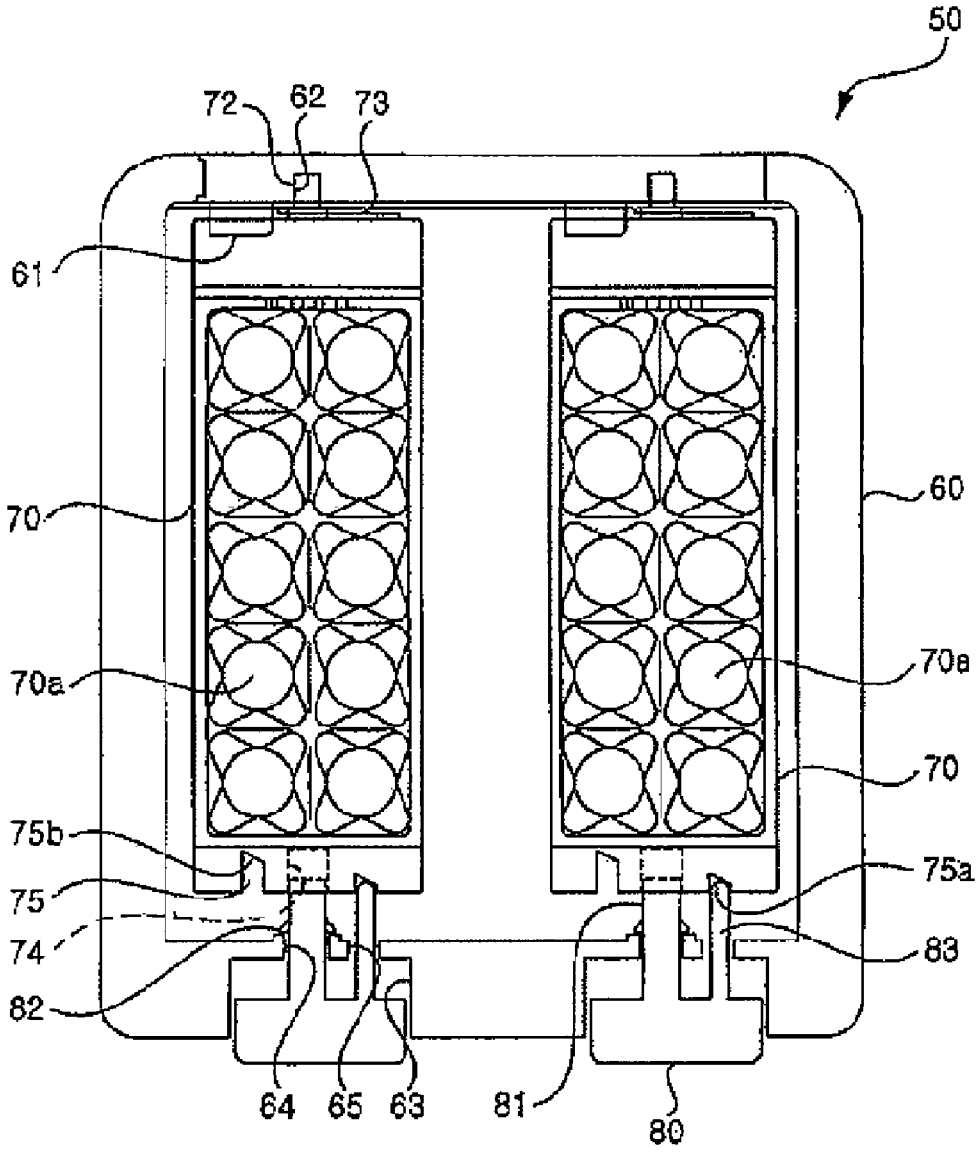
FIG. 1 is a plan view illustrating an ice making device according to the present invention.
Figure 2:
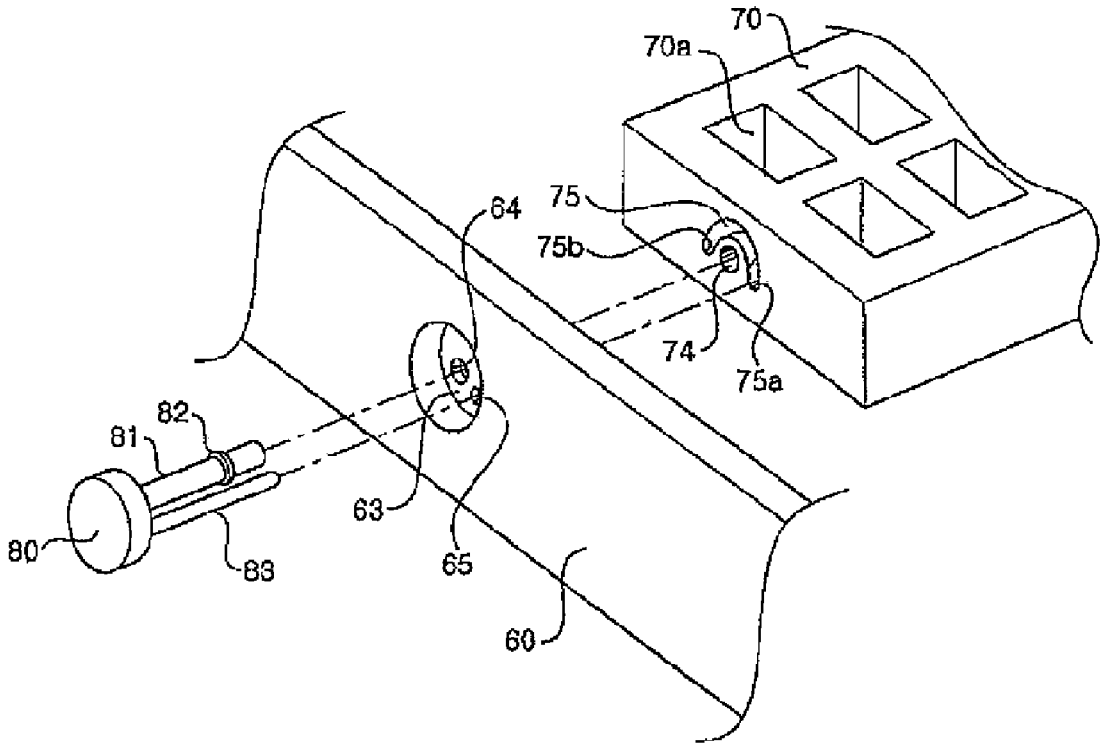
FIG. 2 is an exploded perspective view, in part, of the ice making device shown in FIG. 1.
Figure 3:
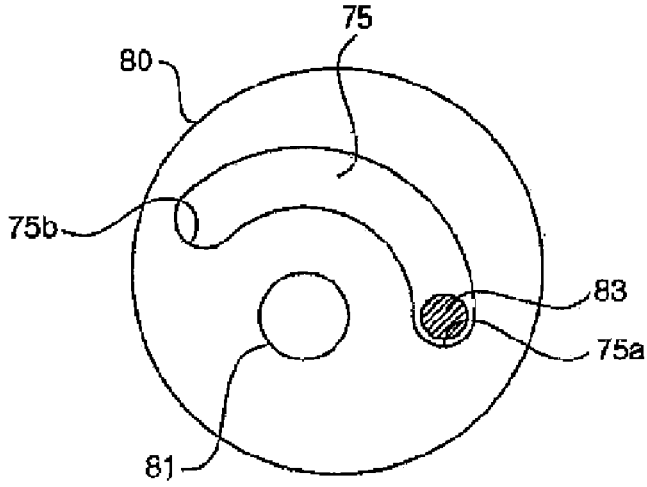
FIGS. 3 to 8 are views illustrating a rotating process of an ice tray of the ice making device shown in FIG. 1.
Figure 4:
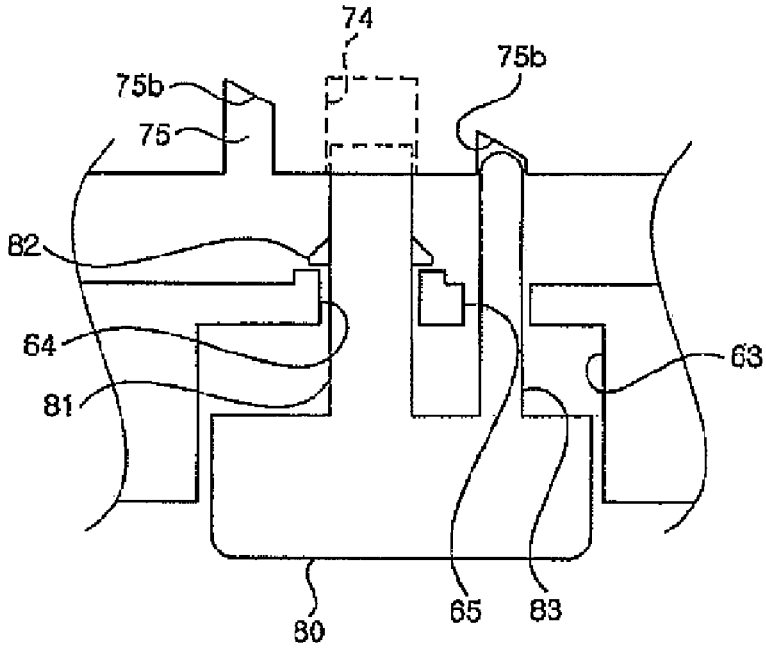

FIG. 1 is a plan view illustrating an ice making device according to the present invention, and FIG. 2 is an exploded perspective view, in part, of the ice making device shown in FIG. 1.

As shown in FIGS. 1 and 2, an ice making device 50 for refrigerators includes a support frame 60, which is formed in the shape of a rectangular frame. The support frame 60 serves to rotatably support ice trays 70, which will be described below.

At the inner side of the support frame 60 are formed stoppers 61. The stoppers 61 support the corresponding ice trays 70 such that the ice trays 70 are horizontally maintained. Also, each stopper 61 serves to twist the one end of the corresponding ice tray 70 with respect to the other end of the ice tray 70 when the ice tray 70 is rotated by a predetermined angle.

At the inner side of the support frame 60, corresponding to the right side of each stopper 61, are formed an insertion groove 62. In the insertion groove 62 is fitted a corresponding rotary shaft 72, which will be described below.

At the front of the support frame 60 are formed button mounting parts 63. The button mounting parts 63 are formed at the front of the support frame 60 such that the button mounting part 63 are depressed backward. In the inner side of each button mounting part 63 are formed a pair of through-hole, i.e., a first through-hole 64 and a second through-hole 65.

On the other hand, a pair of ice trays 70 are mounted in the support frame 60. Each ice tray 70 is formed in a rectangular shape having a lateral width less than that of the support frame 60. Each ice tray 70 is provided with a plurality of ice making grooves 70*a*, which is filled with water necessary to make ice.

At the rear of each ice tray 70 is formed a rotary shaft 72, which protrudes backward. The rotary shaft 72 is rotatably fitted in the corresponding insertion groove 62 such that each ice tray 70 can be rotated with respect to the support frame 60.

On the other hand, an elastic member, for example, a coil type torsion spring 73 is mounted on each rotary shaft 72. Opposite ends of the torsion spring 73 are supported at one side of the support frame 60 and one side of the corresponding ice tray 70, respectively. The torsion spring 73 serves to apply a restoring force to the corresponding ice tray 70 such that the ice tray 70 can be rotated in the direction opposite to the rotating direction in which ice is separated from the corresponding ice tray 70.

At the rotational center of the front of each ice tray 70 is formed a support hole 74. The support hole 74 is formed in such a manner that a portion of the front of the ice tray 70 is depressed backward. In the support hole 74 is fitted in a support shaft 81, which will be described below.

At the front of each ice tray 70 is formed a guide groove 75. As shown in FIG. 2, the guide groove 75 is formed in the longitudinal sectional shape of an arc about the support hole 74.

The guide groove 75 is constructed such that the cross-sectional depth of the guide groove 75 is gradually increased from one end to the other end of the guide groove 75. Hereinafter, one end of the guide groove 75 at which the cross-sectional depth of the guide groove 75 is relatively small will be referred to as a first end 75*a*, and the other end of the guide groove 75 at which the cross-sectional depth of the guide groove 75 is relatively large will be referred to as a second end 75*b*.

On the other hand, a manipulation button 80 is mounted in each button mounting part 63. The manipulation button 80 is formed in the shape of a cylinder having a diameter less than that of the button mounting part 63.

At the rear of each manipulation button 80 is formed a support shaft 81, which protrudes backward. When the manipulation button 80 is mounted in the corresponding button mounting part 63, the support shaft 81 is inserted through the first through-hole 64, and the end of the support shaft 81 is inserted into the corresponding support hole 74 such that the end of the support shaft 81 can be moved forward and backward, whereby the corresponding ice tray 70 is rotatably supported by the support shaft 81.

At one side of the circumference of the support shaft 81 is formed a catching protrusion 82. The catching protrusion 82 protrudes by a predetermined thickness from the circumference of the support shaft 81 to prevent the support shaft 81 from being separated from a position where the support shaft 81 is inserted through the first through-hole 64.

Also, as shown in FIG. 1, a guide protrusion 83 is formed at the rear of each manipulation button 80 corresponding to the right side of the corresponding support shaft 81. The guide protrusion 83 protrudes backward from the rear of the manipulation button 80.

When the manipulation button 80 is mounted in the corresponding button mounting part 63, the guide protrusion 83 is inserted through the second through-hole 65 such that the end of the guide protrusion 83 is inserted into the corresponding guide groove 75.

Hereinafter, a rotating process of each ice tray 70 according to the present invention will be described in more detail with reference to the accompanying drawings.

FIGS. 3 to 8 are views illustrating a rotating process of each ice tray of the ice making device shown in FIG. 1.

As shown in FIGS. 3 to 8, when the manipulation button 80 is mounted in the button mounting part 63, the support shaft 81 is inserted through the first through-hole 64, and the end of the support shaft 81 is inserted into the support hole 74 such that the end of the support shaft 81 can be moved forward and backward, whereby the ice tray 70 is rotatably supported by the support shaft 81.

The end of the support shaft 81 is positioned in the support hole 74 such that the end of the support shaft 81 is spaced apart from the bottom of the support hole 74. The guide protrusion 83 is inserted through the second through-hole 64, and the end of the guide protrusion 83 is positioned in the guide groove 75 such that the end of the guide protrusion 83 is brought into tight contact with the bottom of the first end 75*a* of the guide groove 75.

Figure 5:
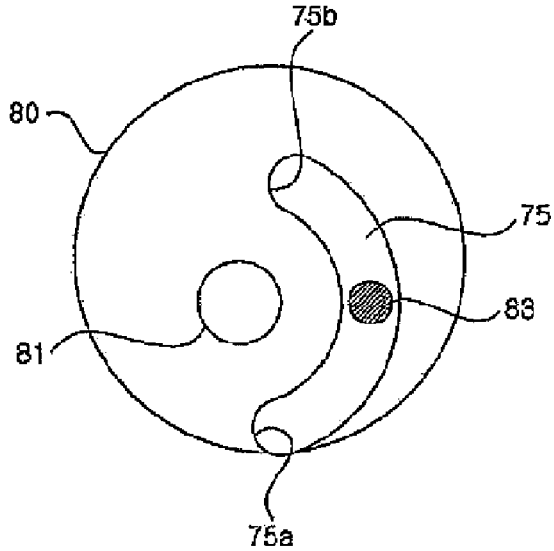
Figure 6:
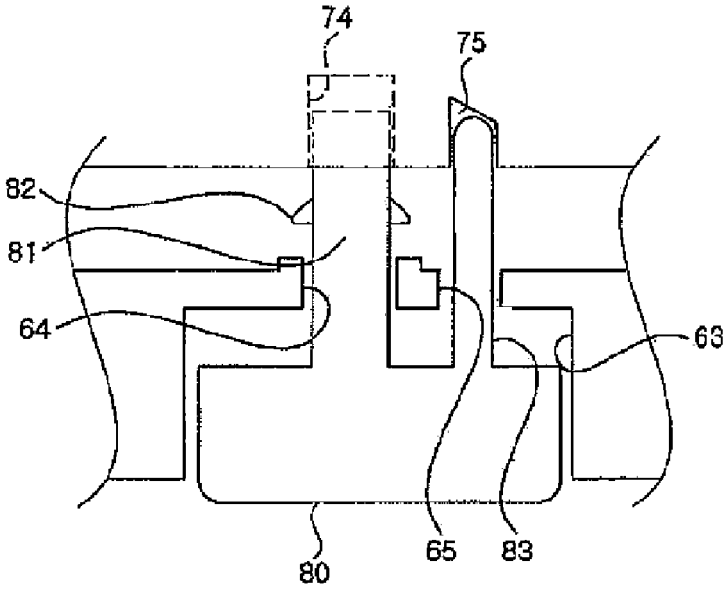

When a user pushes the manipulation button 80 in the above-described state, the support shaft 81 moves by a distance equivalent to the movement distance of the manipulation button 80, as shown in FIGS. 5 and 6, with the result that the end of the support shaft 81 is adjacent to the bottom of the support hole 74.

Also, the end of the guide protrusion 83 pushes the guide groove 75, while the end of the guide protrusion 83 is in tight contact with the bottom of the first end 75*a* of the guide groove 75, by a distance equivalent to the movement distance of the manipulation button 80.

As described above, the cross-sectional depth of the guide groove 75 is gradually increased from the first end 75*a* to the second end 75*b* of the guide groove 75. Consequently, when the guide protrusion 83 is pushed, while the guide protrusion 83 is in tight contact with the bottom of the first end 75*a* of the guide groove 75, the guide protrusion 83 moves toward the second end 75*b* of the guide groove 75.

At this time, only the forward-and-backward movement of the guide protrusion 83 through the second through-hole 65 is possible. Consequently, when the guide groove 75 is rotated in the clockwise direction on the drawing, and therefore, the ice tray 70 is rotated in the clockwise direction on the drawing. When the ice tray 70 is rotated by a predetermined angle, one end of the ice tray 70 is brought into tight contact with the stopper 61.

Figure 7:
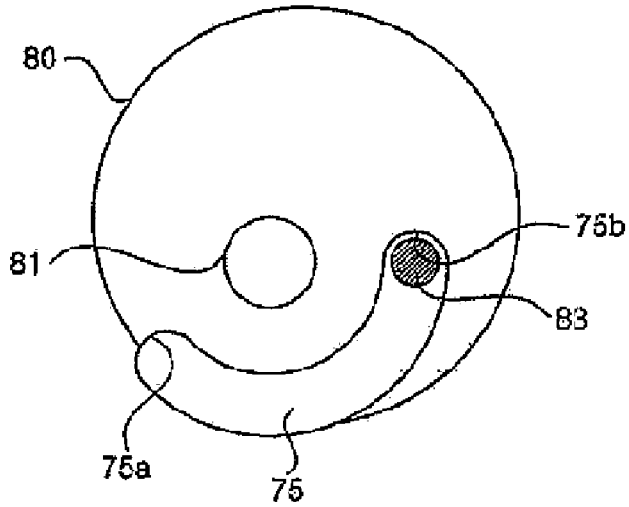
Figure 8:
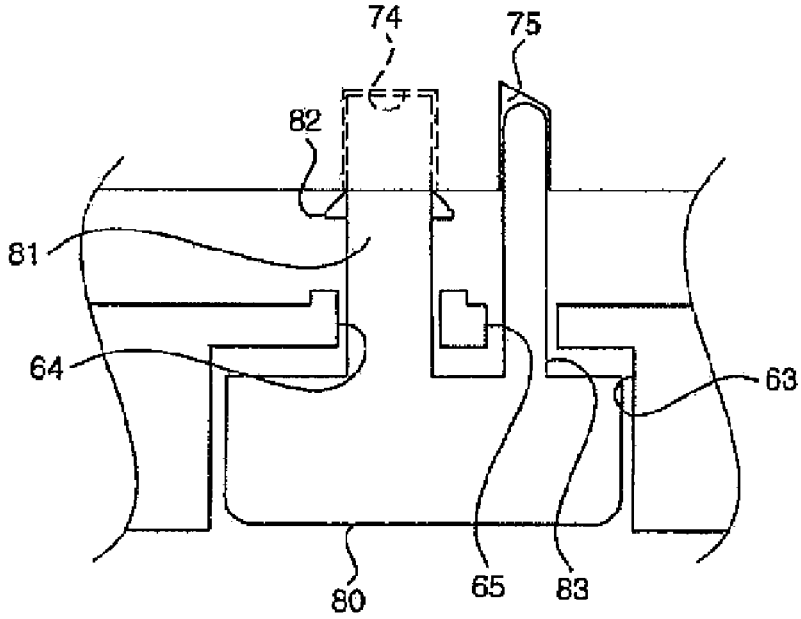
Figure 9:
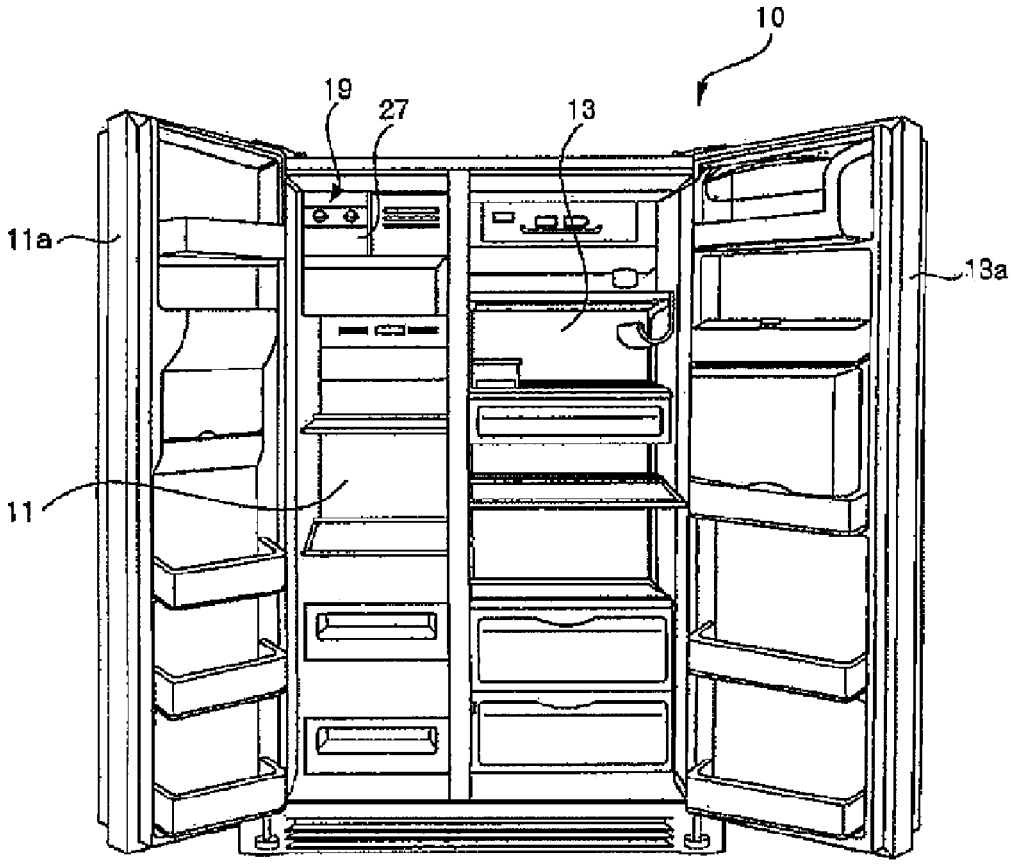
FIG. 9 Related Art
FIG. 9 is a front view illustrating a conventional refrigerator.
Figure 10:
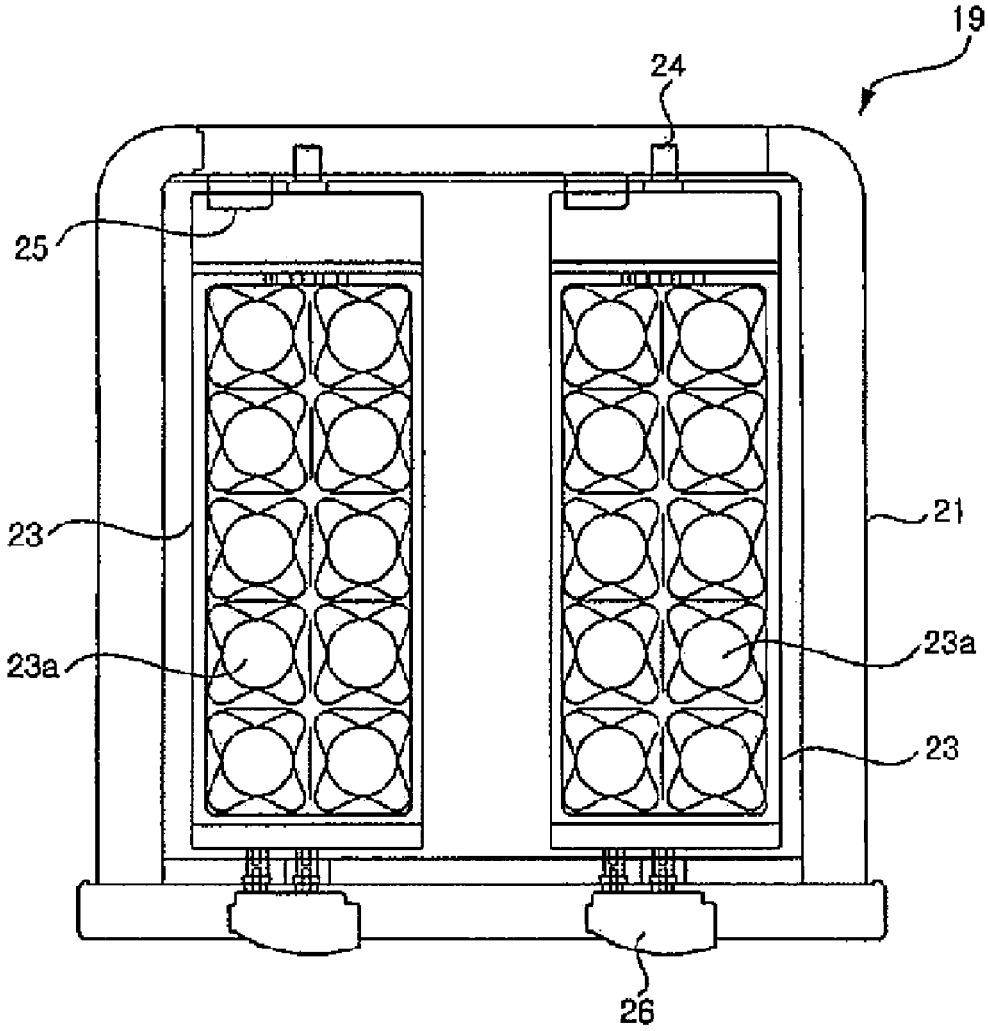
FIG. 10 Related Art
FIG. 10 is a plan view illustrating an ice making device of the refrigerator shown in FIG. 9.

When the user continues to push the manipulation button 80 in the above-described state, the support shaft 81 continues to move by a distance equivalent to the movement distance of the manipulation button 80, as shown in FIGS. 7 and 8, with the result that the end of the support shaft 81 is brought into tight contact with the bottom of the support hole 74.

Also, the end of the guide protrusion 83 continues to push the guide groove 75 by a distance equivalent to the movement distance of the manipulation button 80, with the result that the guide groove 75 is rotated in the clockwise direction on the drawing.

Consequently, the ice tray 70 is rotated in the clockwise direction on the drawing. At this time, one end of the ice tray 70 is in tight contact with the stopper 61, and therefore, the other end of the ice tray 70 is rotated with respect to one end of the ice tray 70, with the result that the ice tray 70 is twisted. As the ice tray 70 is twisted, ice is separated from the ice making grooves 70*a*.

On the other hand, the elastic member, i.e., the torsion spring 73, applies a restoring force to the ice tray 70 such that the ice tray 70 can be rotated in the direction opposite to the rotating direction in which the ice is separated from the ice making grooves 70*a*. Consequently, when the user releases a force applied to the manipulation button 80, the ice tray 70 is rotated in the counterclockwise direction on the drawing.

When the ice tray 70 is rotated, the guide groove 75 is rotated in the counterclockwise direction on the drawing, and therefore, the guide protrusion 83 moves forward. As a result, the support shaft 81 and the manipulation button 80 also move forward, whereby the support shaft 81 and the manipulation button 80 return to the state shown in FIGS. 3 and 4.

As apparent from the above description, the ice making device with the above-stated construction according to the present invention and the refrigerator having the same have the following effects.

When a user simply pushes the manipulation buttons backward, the ice trays are rotated and twisted, with the result that ice is separated from the ice trays. Consequently, it is very easy and convenient to separate ice from the ice trays.

Furthermore, the elastic members apply a restoring force to the ice trays such that the ice trays can be rotated in the direction opposite to the rotating direction in which the ice is separated from the ice trays. Consequently, it is possible to rapidly return the ice trays to their original positions by the user simply releasing a force applied to the manipulation buttons after the ice is separated from the ice trays.

It will be apparent to those skilled in the art that various modifications and variations can be made in the present invention without departing from the spirit or scope of the inventions.

Thus, it is intended that the present invention covers the modifications and variations of this invention provided they come within the scope of the appended claims and their equivalents.

What is claimed is:

1. An ice making device comprising:

a support frame for rotatably supporting at least one ice tray;

at least one manipulation button mounted to the support frame such that the manipulation button can be moved forward and backward; and an interlocking unit for rotating the ice tray with respect to the support frame according to the movement of the manipulation button, wherein the interlocking unit includes a guide protrusion protruding from the manipulation button, and a guide groove formed at the ice tray such that the guide protrusion is guided along the guide groove while the guide protrusion is fitted in the guide groove, the guide groove being formed in the shape of an arc and constructed in a structure in which the depth of the guide groove is gradually increased from one end to the other end of the guide groove.

2. The ice making device according to claim 1, wherein the guide groove is formed such that the guide groove is concentric with a support hole formed at the rotational center of the ice tray.

3. The ice making device according to claim 1, wherein the interlocking unit further includes a support shaft protruding from the manipulation button, the support shaft being fitted in a support hole formed at the ice tray through the support frame such that the support shaft can be moved forward and backward.

4. The ice making device according to claim 3, wherein the support frame is provided with a button mounting part, which is formed in a depressed shape for receiving the manipulation button.

5. The ice making device according to claim 4, wherein the button mounting part is provided with a pair of through-holes, through which the guide protrusion and the support shaft are inserted, respectively.

6. The ice making device according to claim 5, wherein the support shaft is provided with a catching protrusion for preventing the support shaft from being separated from a position where the support shaft is inserted through the corresponding through-hole.

7. The ice making device according to claim 1, further comprising:

an elastic member for applying a restoring force to the ice tray such that the ice tray can be rotated in the direction opposite to the rotating direction of the ice tray in which the ice tray is rotated by the manipulation button.

8. The ice making device according to claim 7, wherein the elastic member has opposite ends fixed to the support frame and the ice tray, respectively.

9. The ice making device according to claim 1, wherein the support frame supports the ice tray such that opposite ends of the ice tray are twisted with respect to each other after the ice tray is rotated by a predetermined angle.

10. A refrigerator having an ice making device, the ice making device comprising:

a support frame mounted at the inside of a door for rotatably supporting at least one ice tray;

at least one manipulation button mounted to the support frame such that the manipulation button can be moved forward and backward; and an interlocking unit for rotating the ice tray with respect to the support frame according to the movement of the manipulation button, the interlocking unit includes a guide protrusion protruding from the manipulation button, and a guide groove formed at the ice tray such that the guide protrusion is guided along the guide groove while the guide protrusion is fitted in the guide groove, the guide groove being constructed in a structure in which the depth of the guide groove is gradually increased from one end to the other end of the guide groove.

11. The refrigerator according to claim 10, wherein guide groove is formed in the shape of an arc.

12. The refrigerator according to claim 10, wherein the guide groove is formed such that the guide groove is concentric with a support hole formed at the rotational center of the ice tray.

13. The refrigerator according to claim 10, wherein the interlocking unit further includes a support shaft protruding from the manipulation button, the support shaft being fitted in a support hole formed at the ice tray through the support frame such that the support shaft can be moved forward and backward.

14. The refrigerator according to claim 13, wherein the support frame is provided with a button mounting part, which is formed in a depressed shape for receiving the manipulation button.

15. The refrigerator according to claim 14, wherein the button mounting part is provided with a pair of through-holes, through which the guide protrusion and the support shaft are inserted, respectively.

16. The refrigerator according to claim 15, wherein the support shaft is provided with a catching protrusion for preventing the support shaft from being separated from a position where the support shaft is inserted through the corresponding through-hole.

17. The refrigerator according to claim 10, wherein the ice making device further comprises:

an elastic member for applying a restoring force to the ice tray such that the ice tray can be rotated in the direction opposite to the rotating direction of the ice tray in which the ice tray is rotated by the manipulation button.

18. The refrigerator according to claim 17, wherein the elastic member has opposite ends fixed to the support frame and the ice tray, respectively.

19. The refrigerator according to claim 10, wherein the support frame supports the ice tray such that opposite ends of the ice tray are twisted with respect to each other after the ice tray is rotated by a predetermined angle.

* * * * *